US005516590A

United States Patent [19]

Olmstead et al.

[11] Patent Number: 5,516,590

[45] Date of Patent: May 14, 1996

[54] FLUORESCENT SECURITY THERMAL TRANSFER PRINTING RIBBONS

[75] Inventors: Michael W. Olmstead, Centerville; Joseph D. Roth; Richard D. Puckett, both of Miamisburg, all of Ohio

[73] Assignee: NCR Corporation, Dayton, Ohio

[21] Appl. No.: 92,296

[22] Filed: Jul. 15, 1993

[51] Int. Cl.[6] ..... B41M 5/26

[52] U.S. Cl. ..... 428/484; 428/195; 428/488.1; 428/488.4; 428/500; 428/521; 428/690; 428/913; 428/914

[58] Field of Search ..... 428/195, 484, 428/488.1, 522, 690, 913, 914, 488.4, 500, 521

[56] References Cited

U.S. PATENT DOCUMENTS

| | | | |
|---|---|---|---|
| Re. 27,770 | 10/1973 | Siegel | 235/61.11 E |
| 2,822,288 | 2/1958 | Harvey, Jr. et al. | 117/33.5 |
| 3,169,186 | 2/1965 | Howard | 250/71 |
| 3,468,046 | 9/1969 | Makishima | 40/2.2 |
| 3,578,136 | 5/1971 | Postal | 197/151 |
| 3,614,430 | 10/1971 | Berler | 250/71 R |
| 3,628,271 | 12/1971 | Carrell et al. | 40/311 |
| 3,886,083 | 5/1975 | Laxer | 252/301.2 R |
| 3,933,094 | 1/1976 | Murphy et al. | 101/426 |
| 4,066,280 | 1/1978 | LaCapria | 283/8 R |
| 4,227,719 | 10/1980 | McElligott et al. | 283/8 R |
| 4,303,307 | 12/1981 | Tureck et al. | 350/276 R |
| 4,429,318 | 1/1984 | Kobata | 346/76 PH |
| 4,451,521 | 5/1984 | Kaule et al. | 428/199 |
| 4,459,055 | 7/1984 | Asakura et al. | 400/237 |
| 4,472,479 | 9/1984 | Hayes et al. | 428/324 |
| 4,522,429 | 6/1985 | Gardner et al. | 283/91 |
| 4,627,642 | 12/1986 | Peronneau et al. | 283/92 |
| 4,627,997 | 12/1986 | Ide | 428/216 |
| 4,657,697 | 4/1987 | Chaing | 252/301.35 |
| 4,662,651 | 5/1987 | Mowry, Jr. | 283/70 |
| 4,791,449 | 12/1988 | Foley et al. | 355/3 R |
| 4,816,344 | 3/1989 | Chiang | 428/483 |
| 4,864,618 | 9/1989 | Wright et al. | 380/51 |
| 4,889,365 | 12/1989 | Chouinard | 283/70 |
| 4,891,351 | 1/1990 | Byers et al. | 503/227 |
| 4,936,607 | 6/1990 | Brunea et al. | 283/70 |
| 4,957,312 | 9/1990 | Morello | 283/89 |
| 4,983,817 | 1/1991 | Dolash et al. | 235/462 |
| 4,995,315 | 2/1991 | Koper et al. | 101/96 |
| 5,006,503 | 4/1991 | Byers et al. | 503/227 |
| 5,033,773 | 7/1991 | Brunea et al. | 283/95 |
| 5,064,221 | 11/1991 | Miehe et al. | 283/67 |
| 5,086,697 | 2/1992 | Koper et al. | 101/336 |
| 5,089,350 | 2/1992 | Talvalkar et al. | 428/484 |
| 5,118,349 | 6/1992 | Jalon | 106/21 |
| 5,120,088 | 6/1992 | Radcliffe et al. | 283/67 |
| 5,127,677 | 7/1992 | Merry | 283/92 |
| 5,135,803 | 8/1992 | Tanaka et al. | 428/260 |
| 5,209,513 | 5/1993 | Batelli et al. | 283/67 |

*Primary Examiner*—Pamela R. Schwartz
*Attorney, Agent, or Firm*—Craig E. Miller

[57] ABSTRACT

Fluorescent security thermal transfer printing ribbons consisting of an elongated backing element having a printing media adhered to one side thereof. The printing media is preferably capable of being transferred to paper, or some other print receiving medium, by conventional thermal transfer printing equipment. If desired, the visible printed images can be made in one configuration, for example, conventional product identification bar codes, and the fluorescent security characters and indicia can be made in a different configuration, for example, the name of a particular store, or the store's logo. Thus, printing ribbons in accordance with this invention can be used to print visibly transparent printing, black printing, or other color printing as viewed under broad spectrum light, and independent fluorescent security characters and indicia which are invisible under broad spectrum light, but which fluoresce, and become visible, when exposed to black light.

4 Claims, 4 Drawing Sheets

FLUORESCENT SECURITY THERMAL TRANSFER PRINTING RIBBONS

BACKGROUND AND SUMMARY OF THE INVENTION

The present invention relates generally to new and novel improvements in fluorescent security printing ribbons. More particularly, the present invention relates to thermal transfer printing ribbons capable of printing security characters and indicia in conjunction with product identification bar codes and other visible printing, such that the security characters and indicia are invisible under broad spectrum light, but fluoresce, and become visible, when exposed to black light.

One prevalent problem in the retail industry is how to verify that merchandise sold to a customer was sold by a particular store. Although the name of the store could be visibly printed on the product's packaging, or directly on the product, doing so is sometimes undesirable to consumers who, for example, may want to give the purchased products to others as gifts, or may want to use the items without visible printing. In addition, if the store name is visible, it is readily apparent and could be fraudulently reproduced by unscrupulous individuals.

Accordingly, an object of the present invention is the provision of printing ribbons capable of printing security characters and indicia incorporated into, for example, product identification bar codes or other visible printing, such that the security characters and indicia are invisible under broad spectrum light, but fluoresce, and become visible, when exposed to black light.

Another object of the present invention is the provision of printing ribbons capable of printing security characters and indicia which are transparent, and thus invisible under broad spectrum light, but which fluoresce, and become visible, when exposed to black light.

A further object of the present invention is the provision of thermal transfer printing ribbons capable of printing fluorescent security characters and indicia using conventional thermal printing equipment.

Yet another object of the present invention is the provision of thermal transfer printing ribbons capable of printing product identification bar codes and other visible images under control of a thermal transfer print head and security characters and indicia controlled, at least in part, by predetermined spot coated patterns or configurations present on the thermal transfer printing ribbons prior to the printing operation.

These and other objects of the present invention are attained by the provision of printing ribbons consisting of elongated backing elements with printing media adhered to one side thereof. The printing media is preferably capable of being transferred to paper, or some other print receiving media, by conventional thermal transfer printing equipment. In one preferred embodiment, the thermally transferred printing media includes a uniform interspersed distribution of fluorescent pigments, resulting in printed security characters and images which are transparent, and thus invisible, under broad spectrum light, but which fluoresce, and become visible, when exposed to black light. In a second preferred embodiment, the thermally transferred printing media includes a uniform interspersed distribution of visible black or colored pigments, as well as fluorescent pigments, resulting in printed product identification bar codes or other visible printed images which are visible under broad spectrum light, as well as printed security characters and indicia which are transparent, and thus invisible, under broad spectrum light, but which fluoresce, and become visible, when exposed to black light. If desired, the visible printed images or patterns can be made in one configuration, for example, conventional product identification bar codes, controlled by the thermal print head and the fluorescent security characters and indicia can be made in a different configuration, for example, the name of a particular store, or the store's logo, controlled, at least in part, by predetermined spot coated patterns or configurations present on the thermal printing ribbons prior to the printing operation. Thus, printing ribbons in accordance with this invention can be used to print visibly transparent printing, black printing, or other color printing as viewed under broad spectrum light, and independent fluorescent security characters and indicia which are invisible under broad spectrum light, but which fluoresce, and become visible, when exposed to black light.

Other objects, advantages and novel features of the present invention will become apparent in the following detailed description of the invention when considered in conjunction with the accompanying drawings.

DETAILED DESCRIPTION OF THE DRAWINGS

Figure 1:
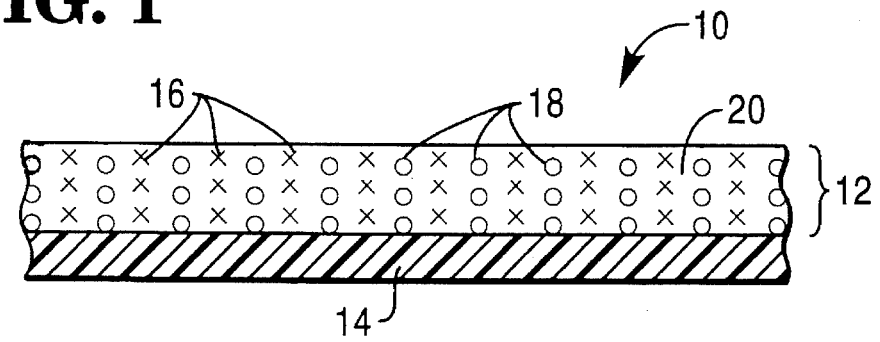
FIG. 1 is a cross-sectional side view of a first preferred embodiment of a fluorescent security thermal transfer printing ribbon in accordance with the present invention having a single printing media layer with a uniform interspersed distribution of visible black or colored pigments and fluorescent pigments.

Referring now to the drawings, in which like-referenced characters indicate corresponding elements throughout the several views, attention is first drawn to FIG. 1 which illustrates a first preferred embodiment of a fluorescent security thermal transfer printing ribbon in accordance with the present invention, generally identified by reference numeral 10. Fluorescent security thermal transfer printing ribbon 10 consists of a single printing media layer 12 which is adhered to one side of elongated backing element 14. Backing element 14 is preferably a long narrow strip of a flexible polymeric material, such as Mylar, available from E. I. Dupont de Nemours & Co., Inc. in Wilmington, Del. Backing element 14 should be compatible with printing media layer 12, and preferably has sufficient tensile strength to resist tearing, while being sufficiently flexible to be wound around a spool or reel.

Printing media layer 12 preferably includes a uniform interspersed distribution of visible black or colored pigments 16 and fluorescent pigments 18 in binding substrate 20. Visible black or colored pigments 16 most preferably include carbon black pigments, but could also include visible green, brown, blue and other colored pigments. Visible black or colored pigments 16 allow the printed image to appear visibly black or colored, as desired, under broad spectrum light. Fluorescent pigments 18 are inactive under broad spectrum light, but fluoresce, and become visible, when exposed to black light.

Binding substrate 20 retains the uniform interspersed distribution of black or colored pigments 16 and fluorescent pigments 18 against backing element 14 prior to the printing operation. In addition, binding substrate 20 retains the uniform interspersed distribution of black or colored pigments 16 and fluorescent pigments 18 once printing media layer 12 is transferred onto paper or some other print receiving medium.

A preferred formulation for the first preferred embodiment of fluorescent security thermal transfer printing ribbon 10 shown in FIG. 1 is given below:

| Ingredient | % Dry | % Dry Range | Grams Dry | Grams Wet |
|---|---|---|---|---|
| Mineral Spirits | — | — | — | 400.0 |
| Copolymer Resin | 5.0 | 2–20% | 5.0 | 5.0 |
| Thermoplastic Resin | 10.0 | 5–25% | 10.0 | 10.0 |
| Rice Bran Wax | 65.0 | 45–75% | 65.0 | 65.0 |
| Carbon Black Pigment | 10.0 | 5–15% | 10.0 | 10.0 |
| Ultraviolet Yellow Pigment | 10.0 | 5–15% | 10.0 | 10.0 |
| Total | 100.0 | | 100.0 | 500.0 |

In the above preferred formulation of fluorescent security thermal transfer printing ribbon 10, the copolymer resin used is marketed as "Lotryl 15MA03 Copolymer Resin" by Elf Atochem in Paris, France; the thermoplastic resin used is marketed as "Stereon 840-A Thermoplastic Resin" by Firestone Tire & Rubber Co. in Akron, Ohio; the rice bran wax used is marketed as "Rice Bran Wax" by Frank B. Ross Co., Inc. in Jersey City, N.J.; the carbon black pigment used is marketed as "Conductex SC Pigment" by Columbia Chemical in Atlanta, Ga.; the ultraviolet yellow pigment used is marketed as "UV Yellow Pigment" by Stroblite Co., Inc. in New York City, N.Y.; and the backing element used is marketed as "4.5 micron Polyester Film" by E. I. Dupont de Nemours & Co., Incorporated in Wilmington, Del.

To fabricate fluorescent security thermal transfer printing ribbon 10, a wax emulsion of mineral spirits, copolymer resin, thermoplastic resin and rice bran wax is made by mixing these ingredients together and heating the mixture to 190° F. for thirty minutes. Next, the carbon black pigment and ultraviolet yellow pigment are added and the resultant mixture is ground in an attritor for approximately ninety minutes. This mixture is then coated at 140°–150° F. onto the backing element at a dry coat weight of 3.1+/–0.5 grams per square meter to form finished fluorescent security thermal transfer printing ribbon 10.

Figure 2:
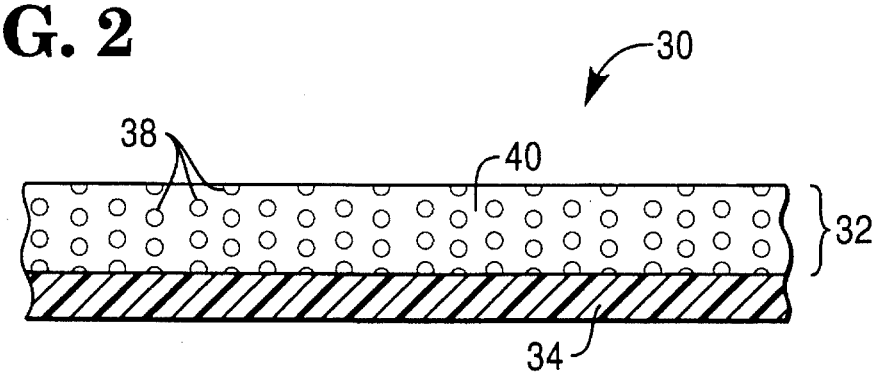
FIG. 2 is a cross-sectional side view of a second preferred embodiment of a fluorescent security thermal transfer printing ribbon in accordance with the present invention having a single printing media layer with a uniform interspersed distribution of fluorescent pigments.

Referring now to FIG. 2, a second preferred embodiment of a fluorescent security thermal transfer printing ribbon in accordance with the present invention, generally identified by reference numeral 30, is shown. Fluorescent security thermal transfer printing ribbon 30 consists of a single printing media layer 32 which is adhered to one side of elongated backing element 34. As in the case of fluorescent security thermal transfer printing ribbon 10 shown in FIG. 1, backing element 34 is preferably a long narrow strip of a flexible polymeric material, such as Mylar, available from E. I. Dupont de Nemours & Co., Inc. in Wilmington, Del. Backing element 34 should be compatible with printing media layer 32, and preferably has sufficient tensile strength to resist tearing, while being sufficiently flexible to be wound around a spool or reel.

Printing media layer 32 preferably includes a uniform interspersed distribution of fluorescent pigments 38 in binding substrate 40. Fluorescent pigments 38 are inactive under broad spectrum light, but fluoresce, and become visible, when exposed to black light. Thus, images printed using fluorescent security thermal transfer printing ribbon 30 are transparent or invisible under broad spectrum light, but become visible when exposed to black light.

Binding substrate 40 retains the uniform interspersed distribution of fluorescent pigments 38 against backing element 34 prior to the printing operation. In addition, binding substrate 40 retains the uniform interspersed distribution of fluorescent pigments 38 once printing media layer 32 is transferred onto paper or some other print receiving medium.

A preferred formulation for the second preferred embodiment of fluorescent security thermal transfer printing ribbon 30 shown in FIG. 2 is given below:

| Ingredient | % Dry | % Dry Range | Grams Dry | Grams Wet |
|---|---|---|---|---|
| Mineral Spirits | — | — | — | 400.0 |
| Copolymer Resin | 5.0 | 2–20% | 5.0 | 5.0 |
| Thermoplastic Resin | 10.0 | 5–25% | 10.0 | 10.0 |
| Rice Bran Wax | 65.0 | 45–75% | 65.0 | 65.0 |
| Ultraviolet Yellow Pigment | 20.0 | 15–25% | 20.0 | 20.0 |
| Total | 100.0 | | 100.0 | 500.0 |

In the above preferred formulation of fluorescent security thermal transfer printing ribbon 30, the copolymer resin used is marketed as "Lotryl 15MA03 Copolymer Resin" by Elf Atochem in Paris, France; the thermoplastic resin used is marketed as "Stereon 840-A Thermoplastic Resin" by Firestone Tire & Rubber Co. in Akron, Ohio; the rice bran wax used is marketed as "Rice Bran Wax" by Frank B. Ross Co., Inc. in Jersey City, N.J.; the ultraviolet yellow pigment used is marketed as "UV Yellow Pigment" by Stroblite Co., Inc. in New York City, N.Y.; and the backing element used is marketed as "4.5 micron Polyester Film" by E. I. Dupont de Nemours & Co., Incorporated in Wilmington, Del.

To fabricate fluorescent security thermal transfer printing ribbon 30, a wax emulsion of mineral spirits, copolymer resin, thermoplastic resin and rice bran wax is made by mixing these ingredients together and heating the mixture to 190° F. for thirty minutes. Next, the ultraviolet yellow pigment is added and the resultant mixture is ground in an attritor for approximately ninety minutes. This mixture is then coated at 140°–150° F. onto the backing element at a dry coat weight of 3.1+/–0.5 grams per square meter to form finished fluorescent security thermal transfer printing ribbon 30.

Figure 3:
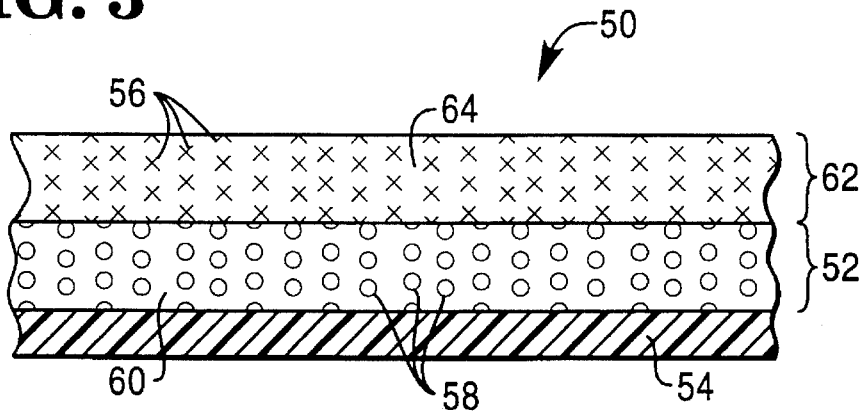
FIG. 3 is a cross-sectional side view of a third preferred embodiment of a fluorescent security thermal transfer printing ribbon in accordance with the present invention having a first printing media layer with a uniform interspersed distribution of black or colored pigments and a second printing media layer with a uniform interspersed distribution of fluorescent pigments.

Referring now to FIG. 3, a third preferred embodiment of a fluorescent security thermal transfer printing ribbon in accordance with the present invention, generally indicated by reference numeral 50, is shown. Fluorescent security thermal transfer printing ribbon 50 consists of first printing media layer 52 which is adhered to one side of elongated backing element 54, and second printing media layer 62 which is adhered to the surface of first printing media layer 52 distal from backing element 54. As in the case of fluorescent security thermal transfer printing ribbon 10 shown in FIG. 1, backing element 54 is preferably a long narrow strip of a flexible polymeric material, such as Mylar, available from E. I. Dupont de Nemours & Co., Inc. in Wilmington, Del. Backing element 54 should be compatible with first printing media layer 52, and preferably has sufficient tensile strength to resist tearing, while being sufficiently flexible to be wound around a spool or reel.

First printing media layer 52 preferably includes a uniform interspersed distribution of fluorescent pigments 58 in binding substrate 60. Second printing media layer 62 preferably includes a uniform interspersed distribution of visible black or colored pigments 56 in binding substrate 64. Thus, images printed using fluorescent security thermal transfer printing ribbon 50 consist of a bottom layer of second printing media layer 62 with a uniform interspersed distribution of visible black or colored pigments 56 in binding substrate 64 and a top layer of first printing media layer 52 with a uniform interspersed distribution of fluorescent pigments 58 in binding substrate 60. Since fluorescent pigments 58 are transparent, and thus invisible under broad spectrum light, visible black or colored pigments 56 allow the printed images to appear visibly black or colored, as desired, under broad spectrum light. However, fluorescent pigments 58 fluoresce, and become visible, when exposed to black light.

Binding substrate 60 retains the uniform interspersed distribution of fluorescent pigments 58 against backing element 54 prior to the printing operation. Similarly, binding substrate 64 retains the uniform interspersed distribution of visible black or colored pigments 56 prior to the printing operation. In addition, binding substrate 60 retains the uniform distribution of fluorescent pigments 58 and binding substrate 64 retains the uniform interspersed distribution of visible black or colored pigments 56 once second printing media layer 62 and first printing media layer 52 are transferred onto paper or some other print receiving medium.

Figure 4:
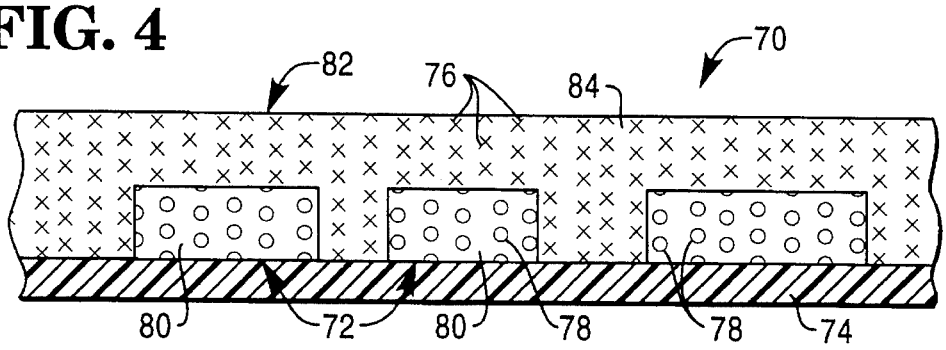
FIG. 4 is a cross-sectional side view of a fourth preferred embodiment of a fluorescent security thermal transfer printing ribbon in accordance with the present invention having a first printing media layer with a uniform interspersed distribution of black or colored pigments and a second printing media layer with a predetermined spot printed configuration of fluorescent pigments.
Figure 5:
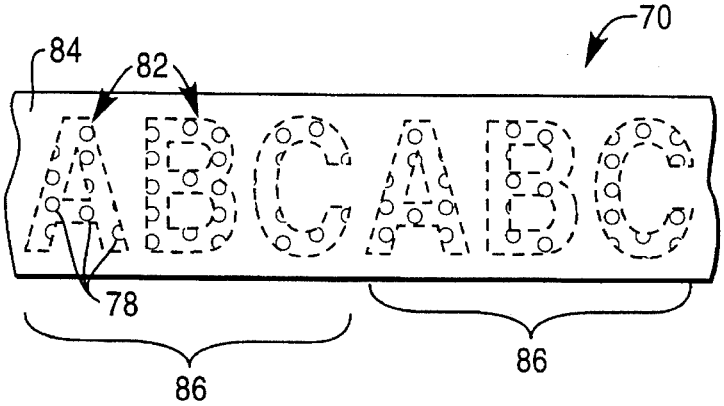
FIG. 5 is a top view of the fluorescent security thermal transfer printing ribbon shown in FIG. 4 showing the spot printed configuration of the second printing media layer adhered to the backing element without the first printing media layer.

Referring now to FIGS. 4 and 5, a fourth preferred embodiment of a fluorescent security thermal transfer printing ribbon in accordance with the present invention, generally indicated by reference numeral 70, is shown. Fluorescent security thermal transfer printing ribbon 70 consists of first spot coated printing media layer 72 which is adhered to one side of elongated backing element 74, and second printing media layer 82 which is adhered to the surface of first spot coated printing media layer 72 distal from backing element 74 and to portions of backing element 74 not covered by first spot coated printing media layer 72. As in the case of fluorescent security thermal transfer printing ribbon 10 shown in FIG. 1, backing element 74 is preferably a long narrow strip of a flexible polymeric material, such as Mylar, available from E. I. Dupont de Nemours & Co., Inc. in Wilmington, Del. Backing element 74 should be compatible with first spot coated printing media layer 72 and second printing media layer 82, and preferably has sufficient tensile strength to resist tearing, while being sufficiently flexible to be wound around a spool or reel.

Figure 6:
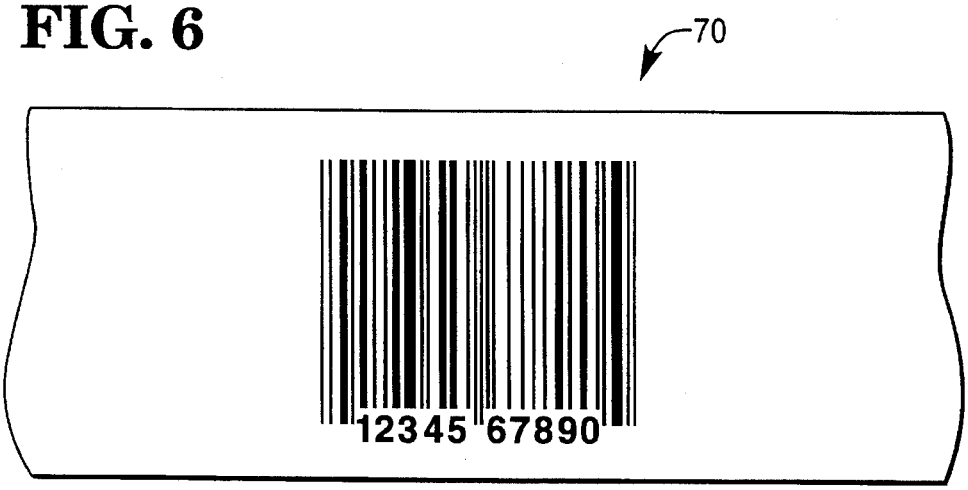
FIG. 6 is a top view of a thermally transferred product identification bar code as printed on paper or some other print receiving medium using the fluorescent security thermal transfer printing ribbon shown in FIG. 4, as the product identification bar code would visibly appear under broad spectrum light.
Figure 7:
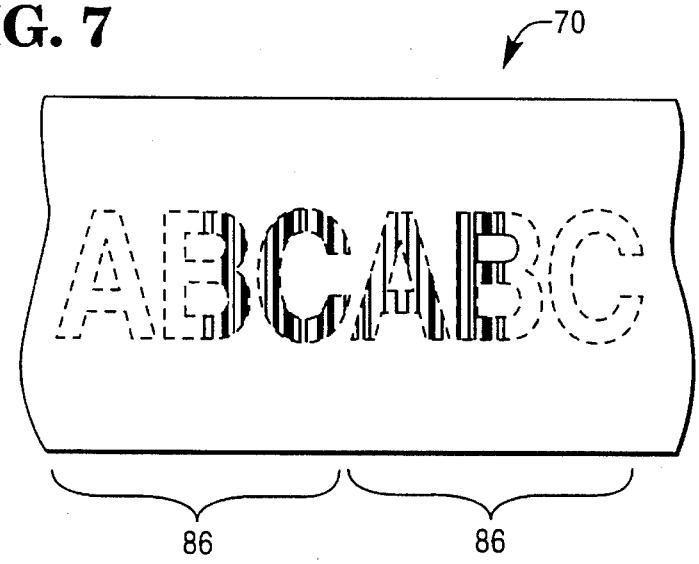
FIG. 7 is a top view of a thermally transferred product identification bar code as printed on paper or some other print receiving medium using the fluorescent security thermal transfer printing ribbon shown in FIG. 4, as the product identification bar code would visibly appear when exposed to black light.

First spot coated printing media layer 72 preferably includes a uniform interspersed distribution of fluorescent pigments 78 in binding substrate 80 spot coated in any desired pattern or configuration on backing element 74. For example, first spot coated printing media layer 72 could be spot coated in a pattern or configuration identifying a particular store's name, logo or some other desired identifiable configuration, as represented by repeating pattern 86 of ABC's shown in FIG. 5. Second printing media layer 82 preferably includes a uniform interspersed distribution of visible black or colored pigments 76 in binding substrate 84. Images printed using fluorescent security thermal transfer printing ribbon 70 consist of a bottom layer of second printing media layer 82 with a uniform interspersed distribution of visible black or colored pigments 76 in binding substrate 84 and a top layer of first spot coated printing media layer 72 with the spot coated pattern or configuration of uniform interspersed distribution of fluorescent pigments 78 in binding substrate 80. Since fluorescent pigments 78 are transparent, and thus invisible under broad spectrum light, visible black or colored pigments 76 allow the printed images to appear visibly black or colored, as desired, under broad spectrum light as shown in FIG. 6. Fluorescent pigments 78 present in repeating pattern 86 fluoresce, and become visible, when exposed to black light as shown in FIG. 7.

Binding substrate 80 retains the spot coated uniform interspersed distribution of fluorescent pigments 78 against backing element 74 prior to the printing operation. Similarly, binding substrate 84 retains the uniform interspersed distribution of visible black or colored pigments 76 prior to the printing operation. In addition, binding substrate 80 retains the spot coated uniform interspersed distribution of fluorescent pigments 78 and binding substrate 84 retains the uniform interspersed distribution of visible black or colored pigments 76 once second printing media layer 82 and first spot coated printing media layer 72 are transferred onto paper or some other printing medium.

Figure 8:
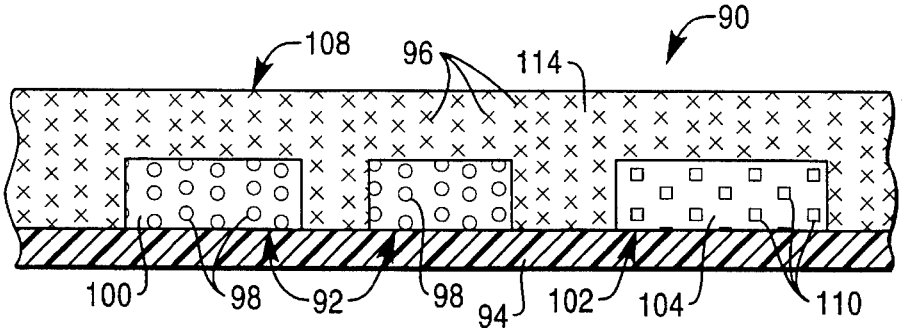
FIG. 8 is a cross-sectional side view of a fifth preferred embodiment of a fluorescent security thermal transfer printing ribbon in accordance with the present invention having a first printing media layer with a uniform interspersed distribution of black or colored pigments, a second printing media layer with a predetermined spot printed configuration of fluorescent pigments, and a third printing media layer with a predetermined spot printed configuration of fluorescent pigments.
Figure 9:
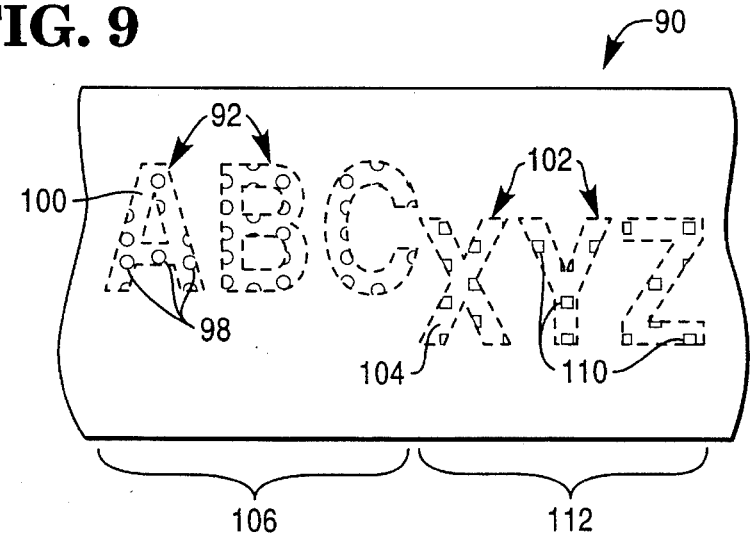
FIG. 9 is a top view of the fluorescent security thermal transfer printing ribbon shown in FIG. 8 showing the spot printed configuration of the second and third printing media layers adhered to the backing element without the first printing media layer.

Referring now to FIGS. 8 and 9, a fifth preferred embodiment of a fluorescent security thermal transfer printing ribbon in accordance with the present invention, generally indicated by reference numeral 90, is shown. Fluorescent security thermal transfer printing ribbon 90 consists of first spot coated printing media layer 92 which is adhered to one side of elongated backing element 94, second spot coated printing media layer 102 which is adhered to the same side of backing element 94, and third printing media layer 108 which is adhered to the surfaces of first spot coated printing media layer 92 and second spot coated printing media 102 distal from backing element 94 and to portions of backing element 94 not covered by first spot coated printing media layer 92 and second spot coated printing media layer 102. As in the case of fluorescent security thermal transfer printing ribbon 10 shown in FIG. 1, backing element 94 is preferably a long narrow strip of a flexible polymeric material, such as Mylar, available from E. I. Dupont de Nemours & Co., Inc. in Wilmington, Del. Backing element 94 should be compatible with first spot coated printing media layer 92, second spot coated printing media layer 102 and third spot coated printing media layer 108, and preferably has sufficient tensile strength to resist tearing, while being sufficiently flexible to be wound around a spool or reel.

First spot coated printing media layer 92 preferably includes a uniform interspersed distribution of fluorescent pigments 98 in binding substrate 100 spot coated in any desired pattern or configuration on backing element 94. Similarly, second spot coated printing media layer 102 preferably includes a uniform interspersed distribution of fluorescent pigments 110 in binding substrate 104 spot coated in any desired pattern or configuration on backing element 94. For example, first spot coated printing media layer 92 could be spot coated in a first pattern or configuration as represented by repeating pattern 106 of ABC's shown in FIG. 9, identifying, for example, a particular store's name, and second spot coated printing media layer 102 could be spot coated in a second pattern or configuration as represented by repeating pattern 112 of XYZ's shown in FIG. 9, identifying, for example, a particular store's logo or some other identifiable configuration. If desired, second spot coated printing media layer 102 could be allowed to overlap first spot coated printing media layer 92 in a predetermined manner. Third printing media layer 108 preferably includes a uniform interspersed distribution of visible black or colored pigments 96 in binding substrate 114.

Figure 10:
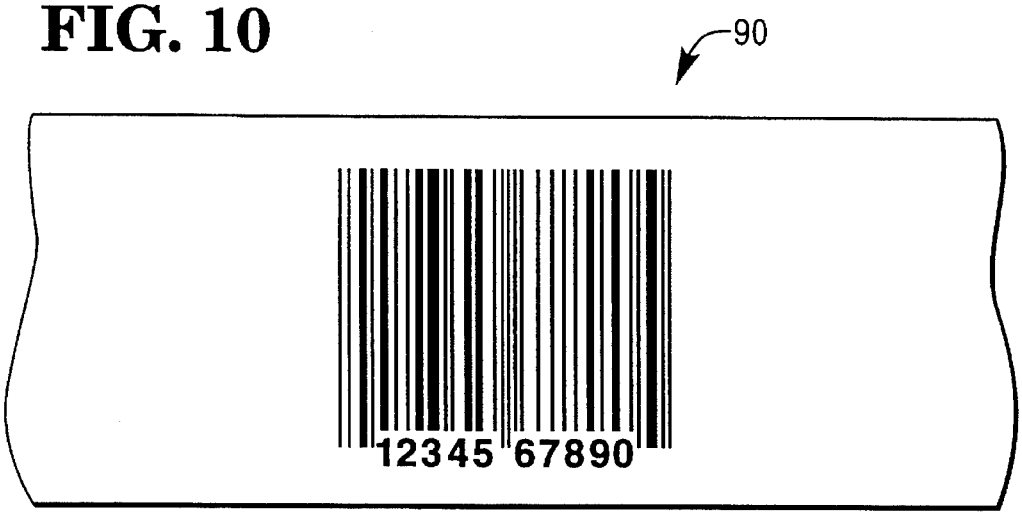
FIG. 10 is a top view of a thermally transferred product identification bar code as printed on paper or some other print receiving medium using the fluorescent security thermal transfer printing ribbon shown in FIG. 8, as the product identification bar code visibly appear under broad spectrum light.
Figure 11:
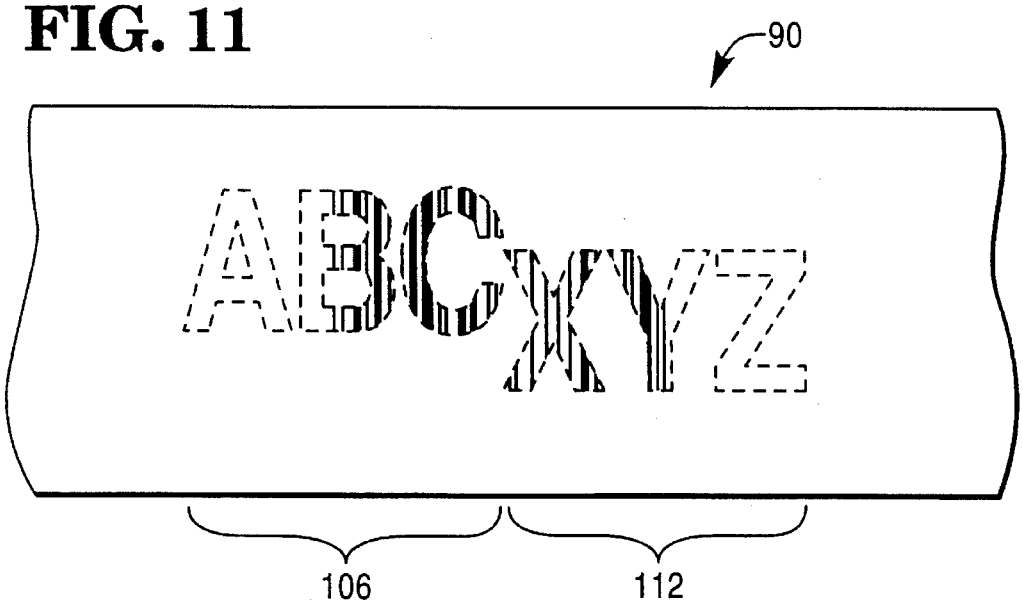
FIG. 11 is a top view of a thermally transferred product identification bar code as printed on paper or some other print receiving medium using the fluorescent security thermal transfer printing ribbon shown in FIG. 8, as the product identification bar code would visibly appear when exposed to black light.

Images printed using fluorescent security thermal transfer printing ribbon 90 consist of a bottom layer of third printing media layer 108 with a uniform interspersed distribution of visible black or colored pigments 96 in binding substrate 114 and a top layer of first spot coated printing media layer 92 with the spot coated pattern or configuration of uniform interspersed distribution of fluorescent pigments 98 in binding substrate 100 and second spot coated printing media layer 102 with the spot coated pattern or configuration of uniform interspersed distribution of fluorescent pigments 110 in binding substrate 104. Since fluorescent pigments 98 and 110 are transparent, and thus invisible under broad spectrum light, visible black or colored pigments 96 allow the printed images to appear visibly black or colored, as desired, under broad spectrum light as shown in FIG. 10. Fluorescent pigments 98 present in repeating pattern 106 and fluorescent pigments 110 present in repeating pattern 112 fluoresce, and become visible, when exposed to black light as shown in FIG. 11. If desired, fluorescent pigments 98 could be a different color or concentration than fluorescent pigments 110 so repeating pattern 106 of fluorescent pigments 98 would appear as a different color or intensity, and thus would be visually distinguishable from repeating pattern 112 of fluorescent pigments 110, when exposed to black light.

Binding substrate 100 retains the spot coated uniform interspersed distribution of fluorescent pigments 98 and binding substrate 104 retains the spot coated uniform interspersed distribution of fluorescent pigments 110 against backing element 94 prior to the printing operation. Similarly, binding substrate 114 retains the uniform interspersed distribution of visible black or colored pigments 96 prior to the printing operation. In addition, binding substrate 100 retains the spot coated uniform interspersed distribution of fluorescent pigments 98, binding substrate 104 retains the spot coated uniform interspersed distribution of fluorescent pigments 110, and binding substrate 114 retains the uniform interspersed distribution of visible black or colored pigments 96 once third printing media layer 108, second spot coated printing media layer 102, and first spot coated printing media layer 92 are transferred onto paper or some other print receiving medium.

Although the present invention has been described above in detail, the same is by way of illustration and example only and is not to be take as a limitation on the present invention. For example, although the use of two spot coated printing media layers has been described herein, the use of three, or even more, such spot coated media layers could be readily accomplished utilizing the teachings of present invention. Accordingly, the scope and content of the present invention are to be defined only by the terms of the appended claims.

What is claimed is:

1. A fluorescent security thermal transfer printing ribbon for printing a printed image having security characters and indicia, said fluorescent security thermal transfer ribbon comprising:

a backing element having a top surface;

a coating layer including 2–20% ethylene methyl acrylate copolymer, 5–25% styrene butadiene elastomer and 45–75% rice bran wax adhered to said top surface of said backing element; and said coating layer having an interspersed distribution of 15–25% ultraviolet yellow pigment such that said printed image is invisible when viewed under broad spectrum light, but fluoresces, and becomes visible when exposed to black light.

2. The fluorescent security thermal transfer printing ribbon in accordance with claim 1, wherein:

said coating layer includes approximately 5% ethylene methyl acrylate copolymer, approximately 10% styrene butadiene elastomer and approximately 65% rice bran wax; and said distribution of ultraviolet yellow pigment includes approximately 20% ultraviolet yellow pigment.

3. A fluorescent security thermal transfer printing ribbon for printing a printed image having security characters and indicia, said fluorescent security thermal transfer printing ribbon comprising:

a backing element having a top surface;

a coating layer including 2–20% ethylene methyl acrylate copolymer, 5–25% styrene butadiene elastomer and 5–25% rice bran wax adhered to said top surface of said backing element; and said coating layer having an interspersed distribution of 5–15% visible black or colored pigments and 5–15% ultraviolet yellow pigments such that said printed image appears visibly black or colored under broad spectrum light and said security characters or indicia are invisible under broad spectrum light, but fluoresce, and thus become visible, when exposed to black light.

4. The fluorescent security thermal transfer printing ribbon in accordance with claim 3, wherein:

said coating layer includes approximately 5% ethylene methyl acrylate copolymer, approximately 10% styrene butadiene elastomer and approximately 65% rice bran wax; and said distribution of visible black or colored pigments and ultraviolet yellow pigments includes approximately 10% visible black or colored pigments and approximately 10% ultraviolet yellow pigments.

* * * * *

UNITED STATES PATENT AND TRADEMARK OFFICE

CERTIFICATE OF CORRECTION

PATENT NO. : 5,516,590

DATED : May 14, 1996

INVENTOR(S) : Michael W. Olmstead et al.

It is certified that error appears in the above-indentified patent and that said Letters Patent is hereby corrected as shown below:

Column 9, line 6, replace "5-25%" before rice bran wax with --45-75%--.

Signed and Sealed this

Twenty-sixth Day of August, 1997

*Attest:*

Bruce Lehman

BRUCE LEHMAN

*Attesting Officer*

*Commissioner of Patents and Trademarks*